US005086545A

United States Patent [19]

Suzuki

[11] Patent Number: 5,086,545

[45] Date of Patent: Feb. 11, 1992

[54] ONE-ACTION PAPER CLIP

[75] Inventor: Takatoshi Suzuki, Abiko, Japan

[73] Assignee: Ohto Kabushiki Kaisha, Tokyo, Japan; a part interest

[21] Appl. No.: 634,729

[22] Filed: Dec. 27, 1990

[30] Foreign Application Priority Data

Jan. 20, 1990 [JP] Japan ..... 2-11201
Sep. 28, 1990 [JP] Japan ..... 2-259883

[51] Int. Cl.[5] ..... A44B 13/00

[52] U.S. Cl. ..... 24/67 R; 24/67.3; 24/346

[58] Field of Search ..... 24/67 R, 67.9, 67.3, 24/546, 556, 550, 552, 346, 333

[56] References Cited

U.S. PATENT DOCUMENTS

| | | | |
|---|---|---|---|
| 2,332,772 | 10/1943 | Amer | 24/346 |
| 2,861,309 | 11/1958 | Saviolides | 24/67 R |
| 3,405,429 | 10/1968 | Vazquez | 24/543 |
| 3,412,739 | 11/1968 | Thatcher | 24/487 |
| 3,806,995 | 4/1974 | Gass | 24/346 |

*Primary Examiner*—Victor N. Sakran

*Attorney, Agent, or Firm*—Fleit, Jacobson, Cohn, Price, Holman & Stern

[57] ABSTRACT

A paper clip has a U-shaped holder containing first group of hairs and second group of hairs in an obliquely inclined abutment relation in the confronting inner surfaces of the U-shaped holder.

6 Claims, 3 Drawing Sheets

ONE-ACTION PAPER CLIP

BACKGROUND OF THE INVENTION

This invention relates to a device for temporarily clamping sheets of paper of various sizes, such as memo sheets, which permits insertion and removal of one or a plurality of sheets of paper either collectively or individually in an easy and quick one-action operation by one hand.

An adhesive tape, a magnet, a drawing pin, a pin, a clip, and various other types of devices, have been used conventionally as a paper clip for temporarily fastening sheet(s) of paper such as memos.

Recently, devices for pressing and anchoring the sheets of paper by utilizing gravity dispersion vectors when a metallic ball or roller is placed on a slope have been proposed (e.g. Japanese Patent Unexamined Publication No. 53-87,818/1978 and Japanese Utility Model Publication No. 43-6,419/1968).

The inventor of present invention proposed the devices which can solve various problems with the prior art devices, as described above, and permit insertion and removal of the sheet(s) of paper by finger-tip manipulation.

A . . . Japanese Utility Model Publication No. 53-51,212 (Reg. No. 1,292,790) published on Dec. 7, 1978, entitled "One-Action Paper Clip".

B . . . Japanese Patent Unexamined Publication No. 60-129,297/1985 published on July 10, 1985, entitled "One-Action Paper Clip".

Hereinafter, these prior art publications will be referred to as the "Prior Art A" and the "Prior Art B", respectively.

In one of the recent products, a specific adhesive is applied to the back of sheets of paper, such as memos, so that the sheets can be fitted and removed repeatedly to and from the fitting surface.

The conventional devices involve the following various problems.

The drawing pin and the pin involve the danger of hurting the human body; the adhesive tape involves a matter of consumption and contaminates the sheets or the fitting surface; the drawing pin and the pin damage the sheets and the fitting surface and can provide only one point of anchoring force, so that the fitting is unstable and unreliable; the appearance at the time of anchoring is clumsy in the case of the adhesive tape, the drawing pin and the pin; the magnet can be used under the condition that the fitting surface be made of a magnetic material; and all these conventional devices require, during the inserting and removing operation, two hands or two or more operations and cannot easily handle a plurality of sheets.

In case of the device employing a metal ball, the there is only one point of anchoring, so the sheets of paper become unstable and at the same time, the anchoring force is extremely low. Though the sheets of paper can be inserted gently from below when the sheets of paper are pulled out downwardly, they are caught between the metal ball and the fitting surface such as a substrate. In addition, the fitting surface must be a slope in order to obtain the function and effect. For these reasons, the device must inevitably have a relatively large thickness.

When a columnar member or roller is used in place of the metal ball, the anchoring force becomes higher and more stable than the metal ball because the force acts on a line, and insertion of the sheet can be made in the same way as in the metal ball. When the sheet is pulled out downwardly, however, the sheet cannot be pulled out because the catch force is far higher than that of the metal ball. Since the sheet cannot be pulled out in the horizontal direction, either due to the structure of the device, the operation of separating the columnar member from the sheet by fingers is first made and then the sheet is pulled out either in the horizontal direction or downwardly. The slope is essentially necessary to obtain such function and effect and the structure must inevitably have a relatively great thickness. Since the problems described above occur even when one sheet of paper is handled, a plurality of sheets cannot be inserted and removed reliably in either of these devices. Further, both of them utilize gravity dispersion vectors, and their fitting angle is not inherently free from the limitation.

The Prior Arts A and B proposed previously by the inventor of the present invention are directed to solve the various problems with the prior art devices and to make it possible to insert and remove a sheet(s) of paper in one action using two fingers of a hand.

With the device of the Prior Art A, one can insert and remove one sheet of paper in one action. Though Prior Art A solves the problems with other conventional devices to some extent, it is not yet free from the problems that made the development of a specific hair implanting machine necessary, and the hair tips of straight hair bundles open in the course of use and fail to keep good contact with a substrate, resulting reduced anchoring forces. Furthermore, when the sheet of paper is removed, the device permits the pull-out operation only in the horizontal direction due to its structural limitation.

The device of the Prior Art B can insert and remove not only just one sheet of paper but also a plurality of sheets in once action and is therefore extremely revolutionary. Although the device Prior Art B solves all the problems with prior art devices, the problem that sheet(s) of paper can be pulled out only along a line in the horizontal direction is left yet unsolved. Moreover, after sheet(s) of paper are accidentally pulled out downwardly, the rubber hairs that remain inverted completely inhibit the re-insertion of sheets in one action.

The principal constituent portions of the Prior Art B are shown in FIG. 9 of the accompanying drawings. As can be seen from this drawing, when the sheet 9 is pulled out downwardly, the rubber hairs 4 that have originally faced obliquely upwardly are pulled downward by the strong contact frictional force with the sheet 9 and thus are inverted as shown in the drawing. After the sheet 9 is pulled out, the hairs 4 cannot return to the original state on their own force because their movement is impeded by a fixed substrate 10, and thus they remain inverted.

To correct this inversion, it is necessary in the Prior Art B to insert once a thick sheet of paper such as a postcard by one hand or a thin sheet such as a memo by both hands from below to above in order to return them to their original state, and then to remove the sheet of the right or left in the horizontal direction.

The Prior Art B exhibits indeed excellent effects so long as it is used in accordance with its correct usage method, but one is apt to pull the sheet out downwardly or obliquely instead of pulling it out to the right or left in the horizontal direction, so that such troublesome correction work must be conducted whenever such mis-usage occurs.

The problem with the Prior Art B is as follows. When the sheet 9 is pulled out in a direction other than the horizontal direction such as the downward direction as in FIG. 9, the tips of the hairs 4, made of rubber, are moved in the interlocking arrangement by the strong frictional force with the sheet 9 and are then inverted downwardly so excessively that the hairs 4 cannot return automatically to their original state as their motion is impeded by the substrate 10 which is fixed and cannot move at all.

Next, the memos or the like which have been put on the market recently and are coated with an adhesive are advantageous because they do not require any devices. However, they involve the following various problems. First of all, it is not easy to write on the memos due to the thickness of the bundle of sheets. If they are peeled off one by one, they become very sticky. As a matter of fact, coating of the adhesive is the essential condition and for this reason, various sizes of sheets to cope with various intended applications must be prepared in advance. When a plurality of sheets are bonded onto a wall surface or the like, it becomes difficult to take out a lower one of them. The price of each sheet is very expensive and the sum in the course of use becomes very high. Moreover, sheets of regular uncoated paper cannot be clipped at all.

SUMMARY OF THE INVENTION

A principal object of the present invention is to provide a new and improved paper clip without the disadvantages and difficulties of conventional devices.

Another object of the present invention is to provide a new paper clip which permits easy handling or operation of paper clipping and removal of same in one action.

A further object of the present invention is to provide a new paper clip which completely solves the disadvantages of the prior art devices and permits the pull out of sheets both downwardly and obliquely as well as horizontally without any problem under conditions of one-action insertion and removal of sheets and can provide the freedom of pulling out sheets at any angle within a range of 180°.

According to the present invention, there is provided a new paper clip comprising a first plate, a second plate extending parallel to said first plate and connected at an end thereof to an end of said first plate to thereby form a substantially U-shaped structure (or more precisely inverted U-shaped structure), a first group of hairs implanted in an inner surface of said first plate and projecting obliquely upward at an angle towards said second plate, a second group of hairs implanted in an inner surface of said second plate and projecting obliquely upward at an acute angle towards said first plate.

In an embodiment of the invention, the paper clip has a brush holder having a first plate and a second plate connected at one end to said first plate to form a U-shape, the first and second brush sheets each having a plurality of hairs projecting obliquely upwardly from confronting inner surfaces of the U-shaped brush holder, each of said hairs having a round cross-section, a round rod-like outer shape and a tip surface parallel to a bottom surface of said first and second brush sheets, wherein the first and second plates have recesses on the confronting inner surfaces of the U-shaped brush holder to receive said first and second brush sheets so that said hairs project in an abutment relation.

One sheet of paper can be inserted and removed in the following way. The role of the hairs or bristles of both brush plates and their movement with respect to the movement of the sheet of paper are exactly the same. During insertion and removal the sheet is effected by the discontinuous surface of the aggregate of a large number of joints between the tips of the hairs of both brush plates and there is no concept at all of utilizing the substrate.

For two or more sheets of paper the principle of action becomes different depending on whether the sheets of paper are handled collectively or individually. If a plurality of sheets are inserted and removed collectively, the principle is the same as when one sheet of increased thickness is handled.

When a plurality of sheets are handled individually, however, the roles and motions of the brush plates and their hairs or bristles for the first sheet and their hairs or bristles for the second sheet become entirely different from the case of the single sheet, for example. Since the sheet of paper is one flat member, the present invention attempts to utilize skillfully this flat member as a constituent element of the substrate 10 (FIG. 9). For example, the aggregate of the first sheet of paper, that has already been inserted, and the hairs of the brush plate form an integral member by strong frictional force, and this member can be utilized as a tentative substrate for the second sheet of paper, so that insertion and removal of the second sheet of paper, so that insertion and removal of the second sheet can be made between the first sheet and the hairs. Though this seems analogous to the principle used in the Prior Art B at first look, it is an entirely novel principle of action and provides entirely novel functions and effects because the first sheet and the like, as the tentative substrate, can move as freely as the flexibility of the rubber hairs permit them to act. Moreover, whether or not this tentative substrate is to be used when inserting and removing the sheet is determined, surprisingly, by the structure of the present invention itself and is determined automatically and appropriately.

Due to the principle of action of the hairs which changes suitably and automatically in accordance with the situation and due to the function of the movable tentative substrate, the present invention provides extremely amazing functions and effects.

The principle of action and its accompanying effects will be described in detail in accordance with the number of sheets in the embodiment of the invention.

BRIEF DESCRIPTION OF THE DRAWINGS

FIGS. 1 to 3 show a first embodiment of the present invention, wherein:

FIG. 1 is a perspective view of the paper clip according to the present invention;

FIG. 2 is a longitudinal sectional view of the paper clip shown in FIG. 1; and FIG. 3 is an exploded view of the paper clip shown in FIG. 1, FIGS. 4 to 8 show the state of hairs in each condition of use in the first embodiment, wherein only a pair of brush plate portions are shown in magnification, and wherein:

FIGS. 6A and 6B are explanatory side views of the paper clip, wherein FIG. 6A shows the state that the downward pull-out operation of one sheet takes place and FIG. 6B shows the state that approximately the half of the sheet of paper has been pulled out;

FIGS. 10A and 10B (Prior Art) are referential figures of drawing showing the main portions of the "Prior Art B", wherein FIG. 10A is a longitudinal sectional view of the side surface when the sheet of paper is inserted from below to above, and FIG. 10B is a transverse sectional view of the top surface when the sheet of paper is pulled out in the horizontal direction;

FIGS. 12A, 12B and 12C are diagrams of a front end view of the hair arrangement, wherein FIG. 12A shows a grid-like arrangement, FIG. 12B shows a zigzag arrangement having continuous points of anchoring (or engagement) action inside the width of two hair rows in the longitudinal direction, and FIG. 12C shows a zigzag arrangement providing the similar effect as FIG. 12B in both longitudinal and transverse directions;

FIGS. 13A, 13B and 13C are side views and show the shape of hairs projecting from a pair or set of brush plates and their joint state, wherein FIG. 13A shows the case where only part of the tip areas join together, FIG. 13B shows the case where their tip surfaces exist on the spatial plane, through the tip surfaces are out of mutual contact, and FIG. 13C shows the case where the tip surfaces oppose mutually with a certain gap between them; and FIGS. 14A and 14B are side views and show the clip where the pair of brush plates are formed in a continuous form, wherein FIG. 14A shows a brush plate chip produced by bonding the pair of brush plates to a thin plate and FIG. 14B shows the state where the hair plate chip is bent in a substantially U-shape so that the tip surfaces of the hairs oppose and come into mutual contact.

PREFERRED EMBODIMENTS OF THE INVENTION

A preferred, basic embodiment of the present invention will be explained with reference to the accompanying drawings. The paper clip of the present invention has an appearance such as shown in FIG. 1 and comprises the combination of components shown in FIG. 3.

Figure 1:
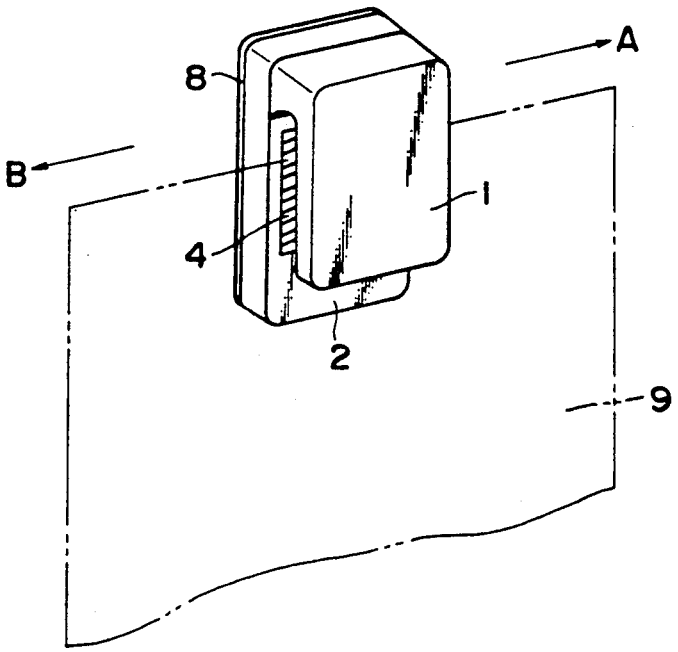
Figure 2:
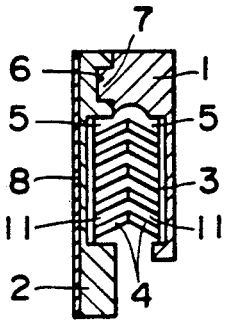
Figure 3:
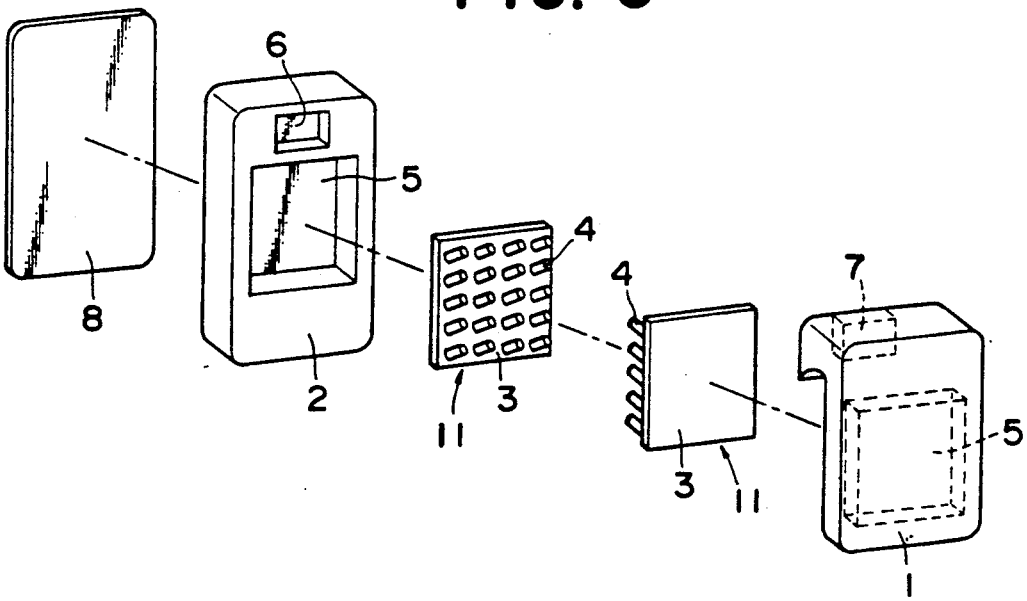

In FIGS. 1, 2 and 3, the paper clip has a front plate 1 and a back plate 2 each having a rectangular groove or recess 5 for storing therein a brush plate 11. The back plate 2 has a bonding groove 6 for receiving fixedly a projection 7 of an L-shaped front plate 1 so that the back plate 2 is integrated with the front plate 1 to form a U-shaped or inverted U-shaped structure. The bonding groove 6 is rectangular so as to meet with the shape of the projection 7, and formed above recess 5, at the upper part of the back plate 2. The recess 5 is formed at the center of the back plate 2. The projection 7 for integrating the front plate 1 with the back plate 2 is formed at the upper part of the front plate 1.

The brush plate 11 consists integrally of a brush sheet 3 and hairs 4 that are molded as a unitary unit from rubber and a plurality of hairs 4 protrude obliquely upwardly from the surface of each brush sheet 3. The orthogonal section of each hair 4 is round and the appearance shape of the hair is round rod-like. Its tip surface is in parallel with the bottom surface of the brush sheet 3. Accordingly, the tip surface has a somewhat elongated elliptic shape. The pair of brush sheets 11 have mutually the same shape and dimension. The brush plates 11 are stored in the brush sheet storage recess 5 of each of the front and back frame plates 1, 2 with the hairs 4 facing obliquely upwardly, and are bonded to the bottom surface of each hair plate storage groove 5 as shown in FIG. 2. The hairs 4 can be formed of filaments or bristles, or any other suitable rod-like components having a tip surface.

The front plate 1 and the back plate 2 obtained in this manner are fitted and bonded to each other by the bonding groove 6 and the bonding protuberance 7 and are thus integrated. At this time, the tip surfaces of the hairs 4 projecting from both brush plates 11 face one another and come into mutual contact throughout the entire surface and each dimension is designed so as to attain such a state.

A double-faced bonding sheet 8 is disposed on the back of the back plate 2, in order to fit the U-shaped main body to the wall, or the like.

Figure 12A:
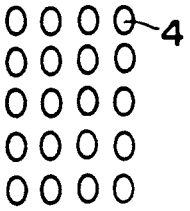
Figure 12B:
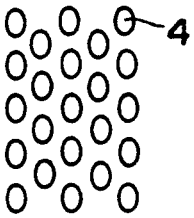
Figure 12C:
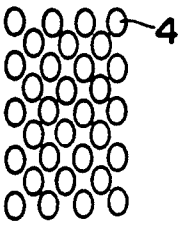
Figure 13A:
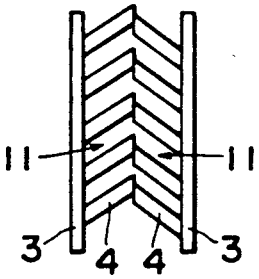
Figure 13B:
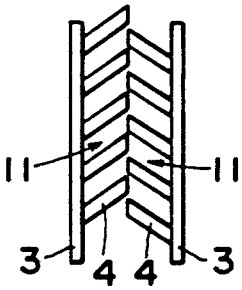

As to the arrangement shape of the hairs 4, three kinds of shapes might be available as shown in FIGS. 12A–12C but the shape shown in FIG. 12A is hereby used for simplification only, but the disposition shape shown in FIGS. 12B and 12C has higher performance for a practical use and, accordingly, the prototype of this embodiment uses the shape of FIG. 13B. The hair diameter is 1.5 mm and its length is 4 mm. The upwardly projecting angle from the horizontal direction is 35° and the hair sheet 3 is a rectangle having the sides of 20 mm and 15 mm and is 1 mm thick. Thirty-two hairs 4 are implanted by disposing alternately five hairs in the longitudinal direction and three or four hairs in the transverse direction. Definite data examples which will appear in the following description are based on the dimensions described above.

Next, the principle of action inserting and removing the sheet(s) of paper in the present invention will be described in detail but the principle differs remarkably between a case of a single sheet of paper and a case of a plurality of sheets of paper. Therefore, the explanation will be given separately for both these cases.

A. A single sheet of paper

First of all, the case of a single sheet of paper will be explained.

Figure 4A:
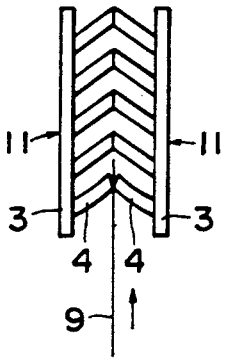
FIG. 4A is an explanatory diagram of a side of the paper clip showing the state that one sheet is being inserted.
Figure 4B:
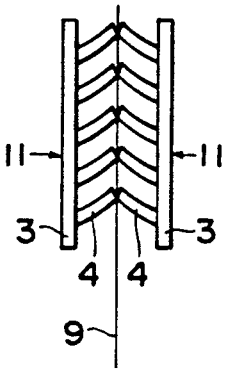
FIG. 4B is an explanatory diagram of a side of the paper clip showing the state that insertion of the sheet of paper is finished.

In FIG. 4A, the upper end of the sheet of paper 9, which is inserted simply from below to above by one hand, first moves a little along the trunk of the hairs 4 and then reaches the joint or endwise abutment portions between the tips of the hairs 4. Since the tips of the hairs 4 join together in the upwardly pointed shape as illustrated, the uppermost edge portion of the sheet of paper 9 does not have any other escape portion. Accordingly, it expands the joint portions between the flexible rubber hairs 4 one after another and advances upwardly and easily. When the sheet of paper enters fully as shown in FIG. 4B, the hairs 4 that come to possess the strain due to the thickness of the sheet of paper 9, or righting moment, press the sheet of paper 9 from both sides and a strong frictional force acts on the tip surface of the hairs 4 and strongly clamps the sheet of paper 9. In this manner, the sheet of paper 9 is easily inserted and clamped in one action by one hand.

When the sheet of paper 9 is about to fall by gravity, the tips of the hairs 4 that move with the sheet of paper describe a downward arc with their root being the center, so that the tips of the hairs 4 extend in the horizontal direction and catch the sheet of paper 9. Accordingly, a stronger clamp force can be obtained and the sheet of paper is held clamped so that it never falls naturally or by gravity.

The description given above deals with the case where the sheet of paper 9 penetrates through above the joint portions of the uppermost hairs 4. Generally, however, the intended object can be accomplished sufficiently if the sheet of paper 9 is inserted into about the half of the longitudinal length of the brush sheet 3. In other words, it may seen doubtful whether or not sufficient clamp force can be obtained and whether or not the sheet of paper falls sooner or later if the sheet of paper is inserted into only about the half of the longitudinal length of the brush sheet 3. However, such a problem does not occur at all because the clamp force of the clip of this invention is extremely strong and the action of the clamp force exists plane-wise throughout the entire surface. Furthermore, the clip of the present invention has extremely particular and amazing function such that when all the factors which might drop the sheet of paper 9, or in other words, external forces such as wind, vibration, impact, and so forth, act on the sheet of paper, the clip lifts up the sheet of paper by utilizing these external forces, as will be described presently in further detail.

Figure 5:
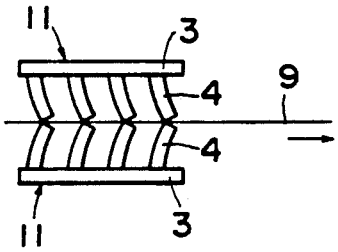
FIG. 5 is an explanatory diagram of a top of the paper clip showing the state that one sheet is being pulled out in a horizontal direction.

Next, the sheet of paper 9 can be pulled out easily by pulling it gently to the right or left in the horizontal direction as shown in FIG. 5 and shown by arrows A and B in FIG. 1. More specifically, when the sheet of paper 9 is pulled, the tips of the hairs 4 on both sides of the sheet of paper 9 move first in the interlocking arrangement due to the strong friction with the sheet of paper 9 but since the tips of the hairs 4 describe the arc with their root being the center, the hairs 4 move in such a manner as to reduce the distance between their tips and the bottom surface of the brush sheet 3. Accordingly, the frictional force between tips and the sheet of paper 9 drops drastically and the sheet of paper 9 can be pulled out easily. Needless to say, the hairs 4 resume their original state due to their righting moment (i.e., restoration) in the sequence of departure from the sheet of paper 9, in this case. The present invention which uses two brush plates 11 provides the really desirable effect that the pull-out resistance can be reduced and, on the other hand, the clamp force becomes higher.

Figure 6A:
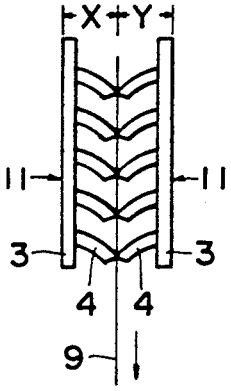
Figure 6B:
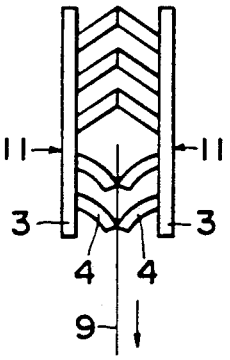

Next, the advantage of the present invention, that can never be accomplished by the conventional device such as the device of the Prior Art B, that is, the effect that the sheet of paper 9 can be pulled out downwardly obliquely, too, without any problem, will be explained with reference to FIGS. 6A and 6B.

When the sheet of paper 9 is pulled out downwardly, resistance is encountered at first until the hairs 4 finish inversion. However, this resistance decreases instantaneously and all the hairs 4 assume the inversion state as shown in FIG. 6A. The reason why inversion of the hairs occurs is as follows. First of all, the tips of the hairs 4 are pulled by the strong frictional force with the sheet of paper 9 and cause arcuate motion. Thus, the hairs 4 are about to extend in the horizontal, or transverse, direction. However, since the sum of length of X and Y has structurally a certain predetermined length, the hairs 4 made by the rubber must bend themselves and thus generate the strain. The strong flexible push force to the sheet of paper 9 generated by this strain increases the frictional force as if the sheet of paper 9 and the tips of the hairs 4 were bonded to one another. Since the sheet of paper 9 is pulled further under this state, the hairs 4 cannot but invert altogether finally.

Figure 9:
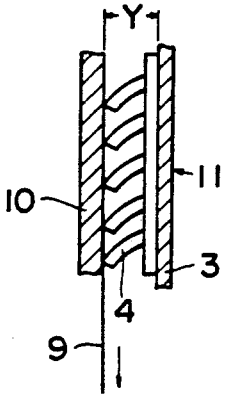
FIG. 9 (PRIOR ART)
FIG. 9 (Prior Art) is a longitudinal sectional view of the side surface of the device of the "Prior Art B" for reference, showing that hairs or bristles cannot return to the original state after inversion as the hairs are impeded by a substrate.

The term "inversion" and its derivatives in this case have an entirely different meaning from "inversion" explained with reference to FIG. 9 of the Prior Art B. It is an instantaneous phenomenon, and at the same time, has an extremely effective meaning. Namely, the inversion time is about some fraction of a second in which the sheet of paper 9 is pulled away quickly, and the hairs 4 which store sufficient righting energy by the inversion jump up extremely vigorously while discharging the energy in the sequence of departure from the sheet of paper 9 as shown in FIG. 6B and return automatically to the original state.

In this instance, it never happens that the hairs 4 impede one another and remain inverted. However, even when the hairs 4 return to their original state, the surfaces of the tips of the hairs 4, which have only a limited area, are not always superposed on upon another throughout their entire surfaces as shown in FIG. 6B, and they fail to join on the full area from time to time. However, this does not render any problem, since this phenomenon has no functional meaning at all after the sheet of paper 9 is pulled out and when the sheet of paper 9 is inserted afresh, it can be inserted with entirely the same insertion resistance and moreover, the tip surfaces of the hairs 4 again return automatically to the same positions by re-insertion of the sheet of paper 9.

As described above, when the sheet of paper 9 is pulled out downwardly, inversion of the hairs 4 is effected instantaneously and altogether and then the return of the hairs 4 to their original state is made sequentially from above to below in accordance with the sequence of departure from the sheet of paper 9. Therefore, at the instant that the sheet of paper 9 is pulled out through the hair 4 at the lowermost end, all the hairs 4 have returned to their original state and are hence ready for accepting another insertion of the sheet of paper 9.

In this manner, the strong demand for the paper clip which makes it possible to pull out the sheet of paper 9 downwardly in one action without any trouble and problem is now accomplished.

Since the pull-out operation of the sheet of paper 9 in the downward direction becomes thus possible, the pull-out operation in the oblique direction, which is the combination of the downward direction and the horizontal direction, the horizontal pulling having been possible already, becomes possible, and the range in which the sheet of paper 9 can be pulled out in one action is extremely expanded and the sheet of paper can be pulled out in one action in any direction within the angle of 180° from the right horizontal direction to the left horizontal direction through the downward direction. This is confirmed sufficiently by the experiments.

The present invention is directed to insert and remove easily the sheets of paper ranging from memos to the sheets of B5 and A4 sizes in one action. From this aspect, the effect that the sheet of paper can be pulled out by merely moving it by 1 to 2 cm in the downward or oblique direction without moving it a long distance in the horizontal direction has very great significance.

Next, insertion and removal of a plurality of sheets of paper 9 will be described. The manner of insertion of sheets is one only, that is, from below to above, even in the case of a plurality of sheets in the same way as in the case of a single sheet. However, the manner of insertion can be divided into collective insertion and individual insertion depending on the number of sheets. The manner of removal of sheets can be divided into the horizontal direction and the downward direction, and into the collective removal and the individual removal. Hereinafter, the explanation will be given in accordance with the number of sheets.

B. Two (2) sheets of paper

The explanation will be given with reference to FIGS. 7A and 7B.

B-a. Collective insertion

Figure 7A:
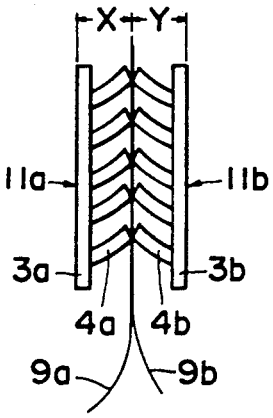
FIG. 7A is an explanatory side view of the paper clip showing the state that two sheets of paper are clamped.

The term "collective insertion" means that a plurality of sheets of paper 9 are inserted altogether simultaneously and in this case, it means that two sheets of paper 9*a*, 9*b* are superposed one upon another and are simultaneously inserted as shown in FIG. 7A. This corresponds to the case where one sheet of paper having the thickness of these two sheets 9*a*, 9*b* is inserted, and the insertion operation can be made without any problem as in obvious from the result of insertion of one sheet of paper as described already. The sheets of paper 9*a*, 9*b* are in contact with the hairs 4*a*, 4*b*, respectively, and obtain the strong press force from them. Therefore, both sheets can obtain stronger anchor force than that of the invention of the Prior Art B.

B-b. Individual insertion

The term "individual insertion" means that a plurality of sheets of paper 9 are inserted one by one. The insertion operation of the first sheet has already been explained.

Assuming that the first sheet is represented by 9*a* and the second sheet by 9*b* in FIG. 7A, the first sheet of paper 9*a* that has already been inserted is tightly clamped by the strong frictional force from the hairs 4*a*, 4*b* in the same way as in FIG. 4B and this sheet of paper 9*a* plays the role of the substrate 10 (FIG. 9) in the Prior Art B for the sheet 9*b* in cooperation with the aggregate of the tip surfaces of the hairs 4*a*, even though its thickness is small.

Figure 10A:
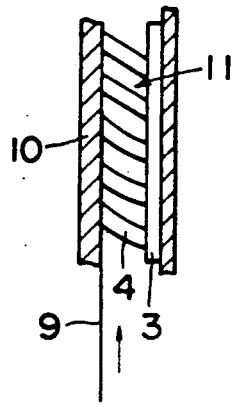
FIG. 10A (PRIOR ART)

With reference to a role of the substrate 10 (FIG. 9), the principle of insertion and removal of the Prior Art B having the substrate 10 will be explained briefly with reference to FIGS. 10A and 10B. When the sheet of paper 9 is inserted from below to above in FIG. 10A, it moves a little along the drum of the hairs 4 and then reaches the boundary between the tips of the hairs 4 and the substrate 10. Next, the uppermost end of the sheet of paper 9 pushes up and expands the tips of the flexible hairs 4 made of the rubber and easily moves upwardly while forming the gap between it and the substrate 10. At this time the hairs 4 undergo deformation and generate strain due to the thickness of the sheet of paper 9. When one separates his hand after completion of the insertion operation, the sheet of paper 9 is clamped between the substrate 10 and the hairs 4 due to the press force and its strong frictional force by the strain of the hairs 4, that is, the righting moment.

Since an element which plays instantly the role of the substrate 10 is the sheet of paper 9*a*, which is integral with the hairs 4*a* in FIG. 7A, it can be understood easily that the sheet of paper 9*b* can be inserted easily from below to above while expanding the tips of the hairs 4*b* at the boundary between the sheet of paper 9*a* and the hairs 4*b*.

Figure 7B:
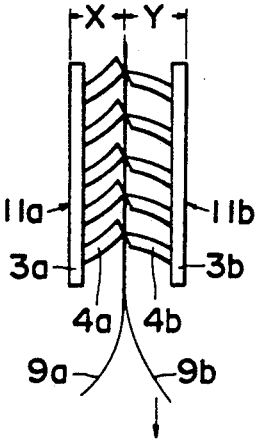
FIG. 7B is an explanatory side view of the paper clip showing that one of the inserted papers is being pulled out downwardly.

In this case of FIGS. 7A and 7B, the sheet of paper 9*a* is always in contact with all the hairs 4*a* and in direct contact with the hairs 4*b* while their contact number is changing, and is clamped by the strong frictional force until the sheet of paper 9*b* passes completely through the uppermost portion of the hairs 4*b*. Even after the sheet of paper 9*b* passes fully through the uppermost hair 4*b*, the sheet of paper 9*a* is anchored by the strong frictional force of all the hairs 4*a*. Accordingly, the sheet of paper 9*a* is never moved or dropped with the insertion of the sheet of paper 9*b*.

The same phenomenon appears even when the insertion sequence of the sheets of paper 9*a* and 9*b* is reversed as is obvious from the symmetrical structure of the clip of the present invention. Thus, each of two sheets of paper 9*a*, 9*b* can be inserted and clamped individually in one action in an arbitrary sequence without any problem.

B-c. Collective removal

This is the same as the case where one sheet of paper 9 having the thickness of two sheets of paper is handled. Accordingly, the sheets of paper can be pulled out naturally in both horizontal and downwardly directions within the angle of 180° in accordance with the sample principle as that of the case of a single sheet of paper.

B-d. Individual removal

The principle of action differs remarkably depending on the removing direction of the sheets of paper 9. (i) When the sheet of paper such as paper 9*b* in FIG. 7A is pulled out in the horizontal direction as shown by arrows A and B in FIG. 1, for example, the sheet of paper 9*a* plays tentatively the role of the conventional substrate 10 (FIG. 9) for the sheet of paper 9*b*.

Figure 10B:
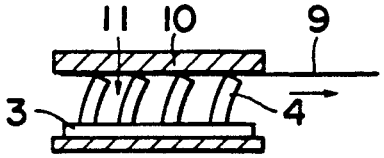
FIG. 10B (PRIOR ART)

In other words, in FIG. 10B, which represents the principle of removal in the horizontal direction, the tips of the hairs 4 move with the sheet of paper 9 with the strong frictional force but since the hairs 4 cause the arcuate motion with their root being the center, almost all the tip surfaces of the hairs 4 leave the sheet of paper 9 and reduce their contact area with the sheet of paper. Accordingly, the frictional resistance is reduced drastically and the sheet of paper can be removed extremely easily.

In FIG. 7A, it is the sheet of paper 9*a* closely integrated with the hairs 4*a* that plays the role of the conventional substrate 10 shown in FIG. 10B, and it is the hairs 4*b* that play the role of the hairs 4. Accordingly, it can be understood easily that the sheet of paper 9b can be pulled out extremely easily to the right and left in the horizontal direction.

The reasons why this removing operation can be conducted without any problem are as follows. The sheet of paper 9a is in close contact with the hairs 4a with the strong frictional force and, moreover, the motion which reduces X and Y occurs with the removing operation, so that the small sliding friction with the sheet of paper 9b further decreases and the movement of the sheet of paper 9a with the sheet of paper 9b does not occur. On the contrary, the sheet of paper 9a is clamped by the stronger force because the hairs 4b return automatically to their original state with the removing operation of the sheet of paper 9b and sequentially come into direct contact with the sheet of paper 9a.

In the manner described above, the sheet of paper 9b can be pulled out to the right or left in the horizontal direction without any problem. The remaining one sheet of paper 9a can be pulled out in the horizontal direction as has been already described. Furthermore, the same result can be obtained due to the symmetric structure of the clip even when the removing sequence of the sheets of paper 9a, 9b is reversed. Thus, even two sheets of paper can be pulled out sequentially to the right or left in the horizontal direction one by one in an arbitrary sequence. (ii) When the sheet of paper is pulled out downwardly, indeed, intricated principles operate cooperatively. The single sheet of paper 9 can be pulled both downwardly and obliquely in one action as described already. In case of two sheets, an entirely different and novel principle from the principle in the case of a single sheet operates automatically and the sheets of paper can be pulled out.

Furthermore, an extraordinary effect can be obtained in that when an arbitrary sheet is pulled out downwardly, the remaining sheet is clamped all the more reliably as its clamp position is raised by 1 to 1.5 mm. The principles of the appearance of such two remarkable effects will be described next.

(1) First of all, the mechanism which makes it possible to pull out independently an arbitrary one of the two sheets in the downward direction without any problem will be explained.

Suppose that the sheet of paper 9b is pulled out downwardly under the state where two sheets of paper 9a, 9b are clamped as shown in FIG. 7A. The hairs 4a, 4b change their shapes as shown in FIG. 7B. The vertical positions of the tips of both hairs 4a, 4b thus become different and at the same time, the clamp state where $X=Y$ now changes to $X<Y$.

The reasons for this change will be described. When an attempt is made to pull out downwardly the sheet of paper 9b, the tips of the hairs 4b are pulled downwardly due to the strong frictional force of the hairs 4b with the sheet of paper 9b. Needless to say, the hairs 4b put together all their righting moment and withstand this pull force but user's pull force is by far stronger than the righting moment, so that the hairs 4b are finally pulled. On the other hand, the sheet of paper 9a is coupled by the strong frictional force with the hairs 4a but its sliding frictional force with the sheet of paper 9b is so small that the sheet of paper 9a is not pulled with the movement of the sheet of paper 9b.

At this time, since the tips of the hairs 4b are to generate the arcuate motion with their roots being the center, the tips extend to the left in the horizontal direction in FIG. 7B and increase the length Y while pushing strongly the sheet of paper 9a and the hairs 4a. In this case, the positions of the tips of the hairs 4b are somewhat lowered from their original positions with pull-down of the sheet of paper 9b, although the hairs 4b are curved upwardly in the upwardly convexed shape. At the same time, though the hairs 4a are to be moved to the left in the horizontal direction due to the push force by the tips of the hairs 4b through the sheets of paper 9a, 9b, the hairs 4a cannot actually be moved since the sum of lengths of X and Y is fixed. Instead, the hairs 4a somewhat rise to keep the sum of lengths X and Y constant. Accordingly, the tip positions of the hairs 4a are somewhat raised and at the same time, the length X is reduced. In this manner, differences occur at the mutual vertical positions at the tips of both hairs 4a and 4b and simultaneously the relation $X<Y$ is established.

When the sheets of paper 9b is pulled downward in FIG. 7B, the length Y gets elongated for the reason described above. As a result, the frictional force between the sheet of paper 9b and the hairs 4b does not become strong to such an extent as to fall in the state shown in FIG. 9. Furthermore, only the limited area of the tip of each hair 4b comes into contact with the sheet of paper 9b due to the arcuate motion as shown in FIG. 7B, and consequently, the sheet of paper 9b cannot obtain the frictional force that can pull down the tips of the hairs 4b against the flexible righting moment of the hairs 4b. Accordingly, only the sheet of paper 9b can move downward, in other words, it can be pulled out without any problem.

While the sheet of paper 9b is being pulled, the tips of the hairs 4b repeat little by little the vertical motion but cannot inverse fully and keep the state such as shown in FIG. 7B.

In other words, the state itself under which the tips of the hairs 4b vibrate and stay at these positions represents a certain kind of equilibrium state. In this case, the force that moves the hairs 4b into the interlocking arrangement with the sheet of paper 9b by the frictional force of the sheet of paper 9b and the righting moment of the hairs 4b that repels the former are balanced as the relation of length of X and Y changes automatically and skillfully.

Due to the principles described above, only one of the sheets of paper can be pulled out downward in one action without dropping the other sheet of paper when the two sheets are clamped.

Since either of the sheets of paper can be pulled out in both horizontal and downward directions, it can be pulled out in the oblique direction as the combination of the two directions described above. Accordingly, the sheets of paper can be pulled out individually within the angle of 180° and this is confirmed sufficiently by experiments.

(2) In addition to the effect described above, the present invention provides a really extraordinary effect. It is the effect that when the sheet of paper 9b is pulled out downwardly, the sheet of paper 9a is simultaneously pushed upward instead of being dropped.

The principle of this phenomenon is as follows. The tips of the hairs 4b, that are considerably lowered from the clamp state shown in FIG. 7A, gradually come into contact sequentially with the sheet of paper 9a as the sheet of paper 9b is being pulled out downwardly at their positions in FIG. 7B but the instant that the sheet of paper 9b is pulled out downwardly, the force by user's hand is not at all transmitted to it. Accordingly, the relation X=Y is established and in this case, the clip has the property that the hairs return to their original balanced state. This action is effected by the cooperation of the hairs 4a and 4b that mutually store the strain or the righting moment. In other words, the hairs 4a that have so far risen remove their strain by lying down to their original positions and elongate the length X at the same time. On the other hand, the hairs 4b whose tips have so far been pulled down to a considerable extent dissipate their strain by returning to their original positions, so that their tips jump up altogether, shorten the length Y and at the same time, accompany compulsively the sheet of paper 9a which is in contact with the hairs 4b with the strong frictional force, against the frictional force with the hairs 4a. Accordingly, the sheets of paper 9a move upwardly by 1 to 1.5 mm from their original clamp positions. Due to the occurrence of this phenomenon, the relation X=Y is established and the hairs return to their original equilibrium state and settle.

Next, when the sheet of paper 9b is pulled out obliquely downwardly, too, the dispersion vector of the elastic righting moment of the hairs 4b acts in the vertical direction, so that the sheet of paper 9a is lifted up, too, though its rise distance is somewhat smaller.

As the result described above, the remarkable effect can be obtained in that if an arbitrary one of the two clamped sheets of paper is pulled out downwardly or obliquely downwardly, the other is lifted up in such a manner that it is clamped more reliably.

C. Three sheets of paper

The case of three sheets of paper will be explained with reference to FIG. 8 while referring also to FIGS. 7A and 7B.

C-a. Collective insertion

This case can be regarded the same as the case where a single sheet of paper having the increased thickness is inserted. Therefore, the principle is the same as that of the case of the single sheet of paper.

C-b. Individual insertion

The case where the two sheets of paper 9a, 9b are individually inserted and attain the state shown in FIG. 7A has already been described. At this time, these two sheets of paper are tightly clamped by the hairs 4a, 4b and are in close contact with each other as if they were a single sheet of paper. Thus, they play the role of the conventional substrate 10 (FIG. 9) in the Prior Art B for the sheet of paper 9c in cooperation with the hairs 4a. Accordingly, the sheet of paper 9b can be inserted easily between the sheet of paper 9b and the hairs 4b while expanding up the tips of the hairs 4b. After all, the three sheets of paper can be inserted individually in one action.

In this case, the sheets of paper 9a and 9b neither move nor fall at all with the insertion of the sheet of paper 9c. In other words, any problem does not at all occur, and the reasons are as follows. First, the strong anchoring frictional force of all the hairs 4a always acts on the sheet of paper 9a. Second, the strong anchoring frictional force of the hairs 4b acts on the sheet of paper 9b until the inserted sheet of paper 9c passes through the uppermost hairs 4b with which the sheet of paper 9b are in contact, through the number of contacting hairs changes. Third, after the sheet of paper 9c thus passes through the hairs 4b, the static frictional force between the sheets of paper 9a and 9b is made greater by the strong push force by the hairs 4a and 4b than the sliding frictional force between the sheets of paper 9c and 9b.

Figure 8:
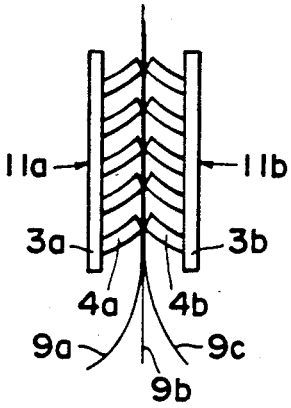
FIG. 8 is an explanatory side view of the paper clip showing that three sheets of paper are clamped.

Next, when the sheet of paper 9c is inserted between the sheets of paper 9a and 9b, though not shown by FIG. 8, it can be inserted without any problem because the insertion force of the sheet of paper 9c by user's hand is by far greater than the sliding frictional force that occurs between the sheets of paper 9c and 9a and between 9c and 9b. After being inserted, the sheet of paper 9c is anchored by the static frictional force of the sheets of paper 9a and 9b for the sheet of paper 9c that results from the push force of the hairs 4a, 4b. In the interim, since the sheets of paper 9a and 9b are anchored reliably and firmly by the strong frictional force of the hairs 4a and 4b, they neither move nor fall.

Accordingly, even when the number of sheets is three, they can be inserted and clamped individually in whichever sequence in one action without any problem.

C-c. Collective removal

This case in the same as the case where a single sheet of paper 9 having the thickness of the three sheets is handled. Accordingly, they can be naturally pulled out within the angle of 180° such as in the horizontal direction or in the vertical direction in accordance with the principle described with reference to the case of one sheet.

C-d. Individual removal (i) When the sheet of paper 9c is pulled out in the horizontal direction in FIG. 8, the integral combination of the sheets of paper 9a, 9b that are firmly pressed and clamped by the hairs 4a, 4b plays the role of the tentative substrate 10 (FIG. 9). Therefore, the sheet of paper 9c can be pulled out in one action as explained above. Here, there might be the doubt whether or not the adjacent sheet of paper 9b is also pulled simultaneously. In the practical use, however, these three sheets of paper are mostly inserted only up to the intermediate portion of the brush plate 11 and the upper ends of the three sheets that are inserted in a free and easy manner are generally non-uniform. Accordingly, the sheet of paper 9b is not fully sandwiched between the sheets of paper 9a and 9c but comes in most cases into contact with both of the hairs 4a, 4b or with at least one of the hairs and receives the anchoring force by this contacting hair. Furthermore, the sliding friction of the sheet of paper 9c to the sheet of paper 9b is smaller than the static friction of the sheet of paper 9a to the sheet of paper 9b. For these reasons, the sheet 9b neither moves nor falls. On the contrary, and the sheet of paper 9c is pulled out, the hairs 4b come into contact with the sheet of paper 9b, so that the sheet of paper 9b becomes less movable. Since the sheet of paper 9a is always in strong contact with the hairs 4a, it is not moved at all.

When the intermediate sheet of paper 9b is pulled out, it can be pulled out in the horizontal direction in one action without moving the sheets of paper 9a, 9c because the contact frictional force of the sheets of paper 9a, 9c with the hairs 4a, 4b is great whereas their sliding frictional force with the sheet 9b is limited.

As described above, any one of the three sheets of paper can be pulled out individually in the horizontal direction by the one-action.

(ii) Next, when the sheet of paper 9c is pulled out downwardly in FIG. 8, the hairs 4a and 4b undergo deformation as shown in FIG. 7B for the same reason as in the case of the two sheets and it can be understood from the principle in the case of the two sheets that the sheet of paper 9c can be pulled out downwardly under this state.

In this case, when the sheet of paper 9c is pulled out downwardly, the sheet 9b is lifted up in a similar manner as described above.

More specifically, the hairs 4b that leave sequentially the sheet of paper 9c in FIG. 8 come sequentially into contact with the sheet of paper 9b under the deformed state in the same way as in FIG. 7B. Then, the instant that the sheet of paper 9c is pulled out completely, the hairs 4b jump up due to their flexible righting moment and, at the same time, lift upwardly while carrying the sheet of paper 9b with them. Thus, the same principle of the action and phenomenon as in the case of two sheets can also be observed.

Moreover, the lift-up distance in this case is greater than in the case of the two sheets. For, the sheet of paper 9a in the case of two sheets shown in FIG. 7B is not lifted up so easily because it is in contact with the hairs 4a with strong friction, whereas in the case of three sheets shown in FIG. 8, the sheet of paper 9b is in contact with the sheet of paper 9a with weak force of the mere static friction and is therefore more easily lifted up.

Next, the case of the intermediate sheet of paper 9b will be considered. In this case, the force that impedes the pull-out operation of the sheet of paper 9b is only the sliding frictional force that develops between the sheets of paper 9a and 9c, and this force is by far smaller than the pull-out force by the hand. Therefore, it can be pulled out downwardly very easily. In this instance, the sheets of paper 9a and 9c neither move nor fall because they are in contact with the hairs 4a and 4b with strong friction. (However, when the intermediate sheet of paper 9b is pulled out downwardly, the action of lifting up the adjacent sheet 9a or 9c does not appear since the sheet of paper 9b is out of contact from both hairs 4a and 4b.) As described, any one of the three sheets can be pulled out downwardly and individually in one action in the pull-out angle range of 180°.

D. Four or more sheets of paper

The similar phenomenon to that of the case of the three sheets can be observed when the sheets of paper are four or more. In other words, the two sheets of paper at both ends among a plurality of sheets which are in contact with the hairs can be inserted and removed with the same principle and the same phenomenon as those of the two sheets of paper at both ends in the case of three sheets.

According to the present invention, the clip permits reliably collective insertion, collective removal and individual insertion of up to about 15 sheets of paper of the B5 size in one action and-which can make individual removal of sheets.

Another remarkable function and effect of the present invention will be described additionally.

For example, if any impact or vibration is applied to the brush plate 11 for some reason or if the sheet of paper 9 flutters in the wind under the clamp state shown in FIG. 4B, the sheet of paper 9 is further lifted up and is clamped all the more reliably. This phenomenon occurs not only in the case where the sheet of paper is only one but when seven or eight sheets of the B5 size are clamped, for example, they are lifted up collectively. Since the definite degree of this performance is associated with the magnitude of the external force, the thickness and weight of the sheets as a whole, the structure of the clip, and so forth, the definite number of sheets cannot be stated so explicitly. This phenomenon occurs not only when the sheet of paper 9 is completely inserted while keeping contact with all the hairs 4 as shown in FIG. 4B but also when the sheet 9 is inserted only about the half of the length of the hair sheet 3, for example.

Figure 11:
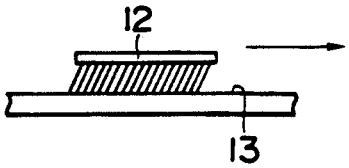
FIG. 11 is, for reference, a front view of a generally known brush, showing diagrammatically the mode of operational movement of hairs or bristles when the brush hairs implanted obliquely exist on a sheet surface.

Although impact, vibration, wind, etc., are all adverse external factors that might originally drop the sheet of paper 9, the structure of the present invention converts them to very useful functions. This principle relies on the phenomenon that when a brush 12 having a large number of hairs 4 extending obliquely in a certain predetermined direction is placed on a plate surface 13 and when any impact or vibration is applied to either the brush 12 or to the sheet surface 13 as shown in FIG. 11, the brush 12 moves to the right in the drawing. When the wind strikes the sheet of paper 9, it generates naturally the vibration and brings forth the same result.

In the present invention, it si the sheet of paper 9 that corresponds to the sheet surface 13 (FIG. 11) and it is the brush plate 11 that corresponds to the brush 12 (FIG. 11). Since this brush plate 11 is fixed, there can be obtained the result that the sheet of paper 9 moves upwardly. In the present invention a pair of brush plates 11 corresponding to the brush 12 (FIG. 11) are employed. The function and effect of the brush become all the more remarkable and a stronger effect than that of the conventional clip shown in FIG. 9.

Next, design and application example of the present invention will be described in detail.

(a) Brush plate

Both natural and synthetic rubbers can be used as the material. In the present invention, butadiene, chloroprene, polythylene, urethane, silicone, or the like, is suitable among various synthetic rubbers from the aspect of the function and effect and chloroprene is relatively superior from the aspect of machining. Natural rubbers are recommendable because they are excellent in both of these aspects.

The term "rubber" is not limitative and other materials such as thermoplastic elastomers can also be used so long as they have frictional force and flexibility equivalent to those of the rubbers.

Both longitudinal and transverse lengths may change in accordance with the object and application and also with the properties of the hairs 4. The size of a length of 20 mm and a width of 15 mm described in the embodiment is one of the suitable examples. If the clip is directed to thin sheets of paper, a smaller length and width and a total area of about the half are preferred from the aspect of insertion resistance. The shape is not limited to the rectangle and any shape can be employed in accordance with the intended appearance of the device.

Figure 14A:
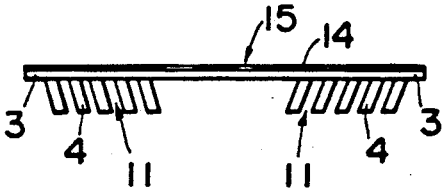
Figure 14B:
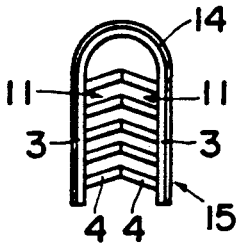

Instead of fixing the pair of brush plates 11 individually to the frame plates 1, 2 as illustrated in FIG. 2, it is possible to employ the structure wherein a brush plate chip 15 is produced by bonding a thin sheet 14 and is being in a substantially U-shape and fitted into the brush plate receiving recess 5 as shown in FIG. 14B. This method is extremely effective for improving productivity.

If it is not efficient to carry out bonding on an individual chip basis, it is advisable to conduct the bonding work under the state where a large number of brush plates continue one after another as they are released from the mold and cut in the size of the chip unit.

When this hair plate chip 15 is produced, the use of a flexible material for the thin sheet 14 provides the following advantages. First, the hair plate chip 15 can be bent automatically into the substantial U-shape by merely bending gently the thin sheet 14 in such a direction as to allow both of the hairs 4 to face one another and by the flexibility of the material, the thin sheet 14 fits automatically and tightly into the bottom surface of the hair plate receiving recess 5 of each plate 1, 2. At the same time, since the upper end of the bent portion of the hair plate clip 15 is pushed by the upper edge of the hair plate storage recess 5, it is tightly clamped between the upper edge and the lower edge of the recess 5. Thus, the hair plate chip 15 is fixed in its vertical direction. Furthermore, since the edge of the side surface of the recess groove 5 checks the shake of the hair plate chip 15 in the horizontal direction, the hair plate chip 15 can be fitted and fixed extremely easily at the accurate position between the plates 1 and 2 while keeping the opposed hairs 4 under the desired state without using at all any fixing means such as an adhesive. After all, this contributes to a remarkable improvement in efficiency of the work.

The continuous hair plate 11 can be bonded onto the bottom surface of the groove or recess 5 of each frame plate 1, 2 without using the thin sheet 14 for the purpose of efficiency in assembly, but the use of the thin sheet 14 improves efficiency in assembly much more because the thin sheet 14 limits flexibility of the hair sheet 3 to make it ready to handle the hair plate 11 and eliminates the necessity for the adhesive.

In order to bulletin a large number of sheets of paper in a transverse line, it is advantageous to produce a paper clip which is elongated in a belt form in the transverse direction by utilizing particularly the feature of the present clip. If necessary, the continuous element consisting of the pair or set of hair plates 11 that continue each other at their upper part or the hair plate chip 15 formed by bonding the thin sheet 14 to the continuous element can e formed by (1) disposing interruptedly a plurality of them in the transverse direction, (2) by disposing continuously a plurality of them in the transverse direction but decreasing the number of lines of the hairs 4 in the longitudinal direction, and (3) disposing continuously a plurality of them in the transverse direction but disposing interruptedly the projecting surface portions of the hairs 4. In this manner, they are fixed through the connecting members such as the transversely elongated belt-like plates (1, 2).

b. Hairs (or bristles)

It is important that the thickness of the hairs is not great and the hairs have an area such that the whole, or part, of their tip surface can change variously and can come into contact with the sheet of paper 9, whenever necessary. Although definite numeric values cannot be given generally to the thickness because it is associated with flexibility of the hairs 4, a diameter of 1.5 mm is one of the suitable examples.

All the hairs 4 have the same thickness inside one brush plate 11 from the aspect of machining and function but similar function and effect can be obtained even when the thickness changes to some extent. A preferable length of the hairs 4 is within the range of from about 4 mm to about 6 mm.

It is extremely important that all the hairs 4 have the same length inside one hair plate 11. However, this can be accomplished automatically so long as machining of the mold sheet material is made uniformly.

Preferably, the tip surface is in parallel with the bottom surface of the hair sheet 3, since when the pair of hair plates 11 are disposed so as to face each other, the tip surfaces of the hairs 4 of both of them can tightly fit to one another and the specific function of the present invention can be exhibited fully. This can be attained easily by merely boring holes obliquely in a mold plate having a uniform thickness by a drill blade.

The most preferred sectional shape of the hair is a round shape because boring of the mold can be made easily by a drill blade and the tip surface of the hairs 4 becomes naturally longitudinally elongated ellipse, with the result that a long anchoring surface is produced in the vertical direction, that is, in the falling direction of the sheet of paper 9. Since the sectional shape of the tip is longitudinally elongated ellipse, the ratio of the contact area of the tip surface of the sheet 9 changes greatly and advantageously between the time of insertion and removal of the sheet 9 and at the time of its clamp. In other words, substantially all the area of the tip surfaces comes into contact with the sheet under the clamp state and only a limited area comes into contact with the sheet of paper 9 at the time of insertion and removal. Accordingly, insertion and removal can be made easily, with desirably high clamp force being obtained.

If the sectional shape is rectangular as an alternative, substantially the same function and effect as those of the round sectional shape can be obtained. However, since the change ratio of the contact area of the tip surfaces to the sheet of paper 9 becomes smaller, resistance tends to increase at the time of insertion and removal of the sheet of paper 9 and, moreover, since electrical discharge machining must be used for producing the mold, the production cost becomes extremely higher. Other sectional shapes such as a diamond, polygons other than rectangles, ellipses, and the like, can be employed and will provide some functions and effects but the production cost of the mold becomes likewise very high for the same reason as described above.

Projection angle of the hairs will be explained.

The term "projecting angle" means the upward angle of the hairs from the vertical line relative to the brush sheet 3. This angle is, in principle, from zero to an angle less than 90° but there is an inevitable limit from the aspects of the mold production, rubber machining and function and effect of the clip hairs. The range of angle satisfying these factors is from about 25° to about 40°, and preferably, from 30° to 35°.

An excessively small angle increases the insertion resistance of the sheet of paper 9 and limits the arcuate motion which provides the specific effects of the hairs. If the angle is too great, on the other hand, stiffness of the hairs 4 becomes weak as a whole, though the insertion resistance of the sheet of paper 9 drops. Accordingly, the strong push frictional force to the sheet of paper 9 cannot be obtained and the aforementioned arcuate motion becomes more difficult. After all, the intended result cannot be obtained sufficiently.

If the angle of zero is employed so that the hairs 4 project orthogonally, or at right angles, from the brush sheet 3, the clip can be used, for merely clamping the sheet of paper 9 but the insertion resistance becomes so high and exceeds the practical limit because the sheet impinges against the drum of each hair 4 at right angles. Furthermore, the excellent effects of the basic embodiment can hardly be obtained.

As to the regular arrangement of hairs, three types shown in FIGS. 12A, 12B and 12C are available.

FIG. 12A shows an ordinary arrangement in the grid form wherein points of anchor action are interrupted. FIG. 12B shows the arrangement wherein the arrangement is zigzag grid and the gap between the hairs 4 in the vertical direction is smaller than the length of the tip surface of the hairs 4 in order to make the arrangement of the points of anchor action denser so that the continuous points of anchor action in the longitudinal direction can be provided if a width corresponding to at least two longitudinal lines of the hairs 4 can be secured. FIG. 12C shows the arrangement wherein the hairs 4 are disposed densely and the continuous points of anchor action are provided within the width of two lines in both the longitudinal and transverse directions.

Density (number) of hairs:

The greater the number of hairs per unit area, the greater becomes the clamp force. However, the insertion resistance and removing resistance increase, on the contrary. Generally, one sheet of paper 9 is extremely light in weight and even one hair 4 on each side can clamp it to some extent. However, stronger clamp force becomes naturally necessary when fifteen, for example, sheets of paper 9 are sequentially inserted. Accordingly, the density is preferably determined through practical experiments inclusive of the feel of handling of the clip after deciding how many sheets of paper of which size are to be clamped.

In the embodiment described above, the number of hairs is set to be 32 while considering 15 sheets as a target number of sheets, and this is an extremely suitable example of density. Speaking limitedly to the various conditions employed in the basic embodiment, the density of hairs is preferably from about 24 to about 36 as the range which makes machining of the mold and rubber processing easy, provides sufficient effects and provides good feel when inserting and removing the sheets of paper 9. This corresponds to from about 8 to 12 hairs per $cm^2$.

c. Shape & disposition method of pair of brush plates

Figure 13C:
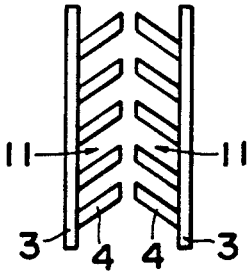

In the basic embodiment described above, the pair of brush plates 11 having exactly the same shape and the same size are disposed to oppose each other and the tip surface of the hairs 4 align completely throughout the entire surface. FIGS. 13A, 13B and 13C show three modified examples by applying this basic embodiment.

(i) FIG. 13A shows the case where the pair of brush plates 11 have the same shape but the tip surface of their hairs 4 are superposed one upon another only partially in the longitudinal or transverse direction or in both directions.

(ii) FIG. 13B shows the case where the pair of brush plates 11 have the same shape but the existing positions of the tips of their hairs 4 are different, so that the tips do not come into mutual contact but the ti p surfaces of all the hairs 4 exist on the same spatial plane. Though not shown in the drawing, it is also possible to employ the disposition wherein the tip surface of the hairs 4 project slightly, e.g. within 1 mm, beyond the tip surfaces of the mating hairs 4 of the brush plates 11.

(iii) FIG. 13C shows the disposition wherein the tip surfaces of the hairs 4 of both of the pair of brush plates 11 are spaced apart from one another so as to define a certain gap between them. This disposition is employed in order to reduce the insertion resistance of the sheet(s) of paper 9 while considering the thickness and to insure reliable clamp of a certain object article other than ordinary sheets of paper 9 by preventing unnecessary rise of the hairs 4. This gap may be within the thickness of one ordinary memory sheet or may be within the thickness of one certain specific article. The position relation of the tips of the hairs 4 of both of them in the vertical and transverse directions need not always be the same position relation as that of the basic embodiment of FIG. 2 in order to obtain the intended effects and this tendency increases more and more with the increasing thickness of the article to be clamped.

d. Plates 1 and 2

The front and back plates 1 and 2 represented in the basic embodiment are mainly directed to fix and couple the pair of brush plates 11. Accordingly, their material may be plastics, wood, metals, or the like, so long as it is a hard material.

The brush plate storage recess 5 is directed mainly to prevent the sheet(s) of paper 9 from impinging against the lower part or the intermediate part of the hairs 4 and from becoming more difficult to insert and secondly, to prevent the unnecessary increase of thickness of the device of the invention. Accordingly, the clip of the invention does not necessarily operate without such recess 5, and a guide for guiding the sheet(s) of paper 9 to the tip of the hairs 4 may be disposed on the plates 1 and 2 instead at the position below the brush plate 11.

The bonding groove 6 and the bonding projection 7 are provided in order to make positioning of both frame plates 1, 2 easier during assembly and are not therefore essential. In short, both plate 1, 2 can be fixed and bonded integrally by use of an adhesive or other means.

The shape of the frame plates 1, 2 is not necessarily limited to the rectangle but may be elongated in a belt-like form, a triangle, a diamond, a circle, a gourd shape or various other shapes. Further, both of the plates 1, 2 need not always have the same shape and their shapes and sizes may be remarkably different from one another depending on the design. In the case of the front frame plate 1, many designs can be made for its surface portion both plane-wise and three-dimensionally, so long as a space for fitting flat the brush sheet 3 can be secured on its back. When this front plate 1 is made transparent, the motion of the internal hairs 4 can be seen and will attract the interest of the user and, at the same time, since the upper part of the sheet(s) of paper, which would otherwise be hidden, can be seen through, and information can be read through the plate.

e. Other structures

A metal or rubber magnet or a sucking disc may be disposed in place of the double-faced adhesive sheet 8, or protuberances which slide in a curtain rail-like grooves may be provided.

Since the present invention has the structure described above, it provides the following extraordinary effects.

1. Even a single or a plurality of sheets of paper can now be pulled out downwardly and obliquely in one action without any problem and eventually, the one-action pull-out direction is now expanded to a wide range of up to 180° from the straight line in the horizontal direction (arrows A and B in FIG. 1), and the clip becomes extremely convenient to use.

2. Since the sheet(s) of paper can be pulled out in the downward direction, too, it is no longer necessary to move first a sheet of paper as large as the A4 size in the horizontal direction by a long distance and then to pull it out.

3. Even a paper clip device which is belt-like and is elongated in the transverse direction can not be realized by utilizing the feature that the sheet(s) of paper can be pulled out downwardly, too, and one-action insertion and removal of a large number of sheets aligned in the transverse direction for bulletining can now be made.

4. When two sheets of paper are clamped, an arbitrary one of them can be pulled out individually, both downwardly and obliquely without any problem, and moreover, the remaining one sheet can be lifted up reliably and is clamped more strongly. The same phenomenon can occur when the number of sheets is three or more.

5. Since two brush plates are used in a confronting relation, two surfaces on which strong anchor force of the hairs act are provided and the clamp force becomes stronger as much in comparison with the conventional clip as the clip of the Prior Art B. Accordingly, the clip can be made more compact.

6. When all the external adverse factors that otherwise cause to drop the sheet of paper such as impact, vibration, wind, etc., act, the clip of the invention utilizes effectively all these factors and further lifts up the sheet so as to clamp it more strongly. This effect appears more remarkably in the present invention that in the Prior Art B.

The following is one of the examples which skillfully utilize this effect. Namely, even when a truck having an engine vibration transmitted thereto is driven while keeping its windows open, a sheet or paper or memo describing the map of destination is neither blown away nor falls and due to the effect of the one-action insertion and removal of the clip, the driver can drive safely and is free from possible accident.

7. A single or plurality of sheets of paper can be inserted and pulled out in complete one action by only one hand.

8. The clip of the invention is not at all dangerous for the human body, does not consume anything and does not either damage or contaminate the sheets of paper or fitting surface. Even a trace of fitting does not remain on the sheets of paper.

9. Since the place at which the anchor force acts exists extremely plane-wise, the sheets of paper can be clamped extremely stably and reliably.

10. Though the clip of the invention is used generally while it is being fitted vertically, the structure itself does not utilize the gravitational force. Accordingly, the same effect can be obtained at any other fitting angle and, in the extreme case, even when the fitting state is inverted.

11. Since the brush plates as the principal constituents of the present invention are so small, the size and shape of the product of this invention can have much freedom and various designs can be made both plane-wise and three-dimensionally. Accordingly, a clip having a sophisticated or fancy designs can be produced.

12. The clip of the present invention is made of an extremely simple material and has an extremely simple structure. It can be produced by use of only the conventional production technique without any novel machine, tools and materials. Though the clip of the invention has extremely excellent functions, it can be produced economically, and does not have any factors for trouble.

As described above, the clip of the present invention solves all the problems of the prior art devices and moreover provides additional remarkable effects.

What is claimed is:

1. A paper clip comprising:

a first plate, a second plate extending parallel to said first plate and connected at an end thereof to an end of said first plate to thereby form a substantially U-shaped structure, a first group of hairs implanted to an inner surface of said first plate and projecting at an acute angle towards said second plate, a second group of hairs implanted to an inner surface of said second plate and projecting at an acute angle towards said first plate, a first recess on an inner surface of said first plate, a second recess on an inner surface of said second plate, a first brush plate including said first group of hairs, a second brush plate including said second group of hairs, wherein said first brush plate is fitted to said first recess and said second brush plate is fitted to said second recess.

2. The paper clip according to claim 1, wherein tip surfaces of said hairs of the first and second groups are out of mutual contact and positioned on the same spatial plane.

3. The paper clip according to claim 1, wherein each of said hairs has a round cross section and a tip surface parallel to the first and second plates.

4. The paper clip according to claim 1, wherein each of said first brush plate with said first group of hairs and said second brush plate and said second group of hairs is integrally formed of a rubber material.

5. The paper clip according to claim 1, wherein said first brush plate and said second brush plate are integrally formed in a belt form so that the belt shaped first and second brush sheets are bent in a U-shape structure.

6. A paper clip comprising:

a brush holder having a first plate and a second plate connected at one end to said first plate and to form a substantially U-shape, first and second brush sheets each having a plurality of hairs projecting obliquely upwardly from confronting inner surfaces of the U-shaped brush holder, each of said hairs having a round cross-section, a round rod-like outer shape and a tip surface parallel to a bottom surface of said first and second brush sheets, wherein the first and second plates have recesses on the confronting inner surfaces of the U-shaped brush holder to receive said first and second brush sheet so that said hairs project in an abutment relation.

* * * * *